US006075958A

United States Patent [19]

Gotoh et al.

[11] Patent Number: 6,075,958

[45] Date of Patent: Jun. 13, 2000

[54] IMAGE FORMING APPARATUS WITH FIRST AND SECOND OPENABLE COVERS

[75] Inventors: Tetsuya Gotoh; Yuji Suzuki, both of Yokohama; Masahiro Nakajima, Tokyo; Shigeru Horiguchi, Kawasaki, all of Japan

[73] Assignee: Ricoh Company, Ltd., Tokyo, Japan

[21] Appl. No.: 09/200,773

[22] Filed: Nov. 30, 1998

[51] Int. Cl.[7] ..... G03G 15/20

[52] U.S. Cl. ..... 399/124

[58] Field of Search ..... 399/110, 124, 399/364, 401, 107, 126; 271/184, 9.01, 9.11

[56] References Cited

U.S. PATENT DOCUMENTS 4,556,308 12/1985 Hoppner et al. ..... 399/111
4,952,989 8/1990 Kawano et al. ..... 399/113
5,255,061 10/1993 Matsuura et al. ..... 399/124
5,396,069 3/1995 Craig et al. ..... 250/330

FOREIGN PATENT DOCUMENTS 8-152756 6/1996 Japan .

*Primary Examiner*—William Royer
*Assistant Examiner*—Hoang Ngo
*Attorney, Agent, or Firm*—Oblon, Spivak, McClelland, Maier & Neustadt, P.C.

[57] ABSTRACT

An image forming apparatus which includes both a front cover and a side cover which must be opened to properly access an area where a paper jam may occur. The side cover includes an extending portion protecting board which extends into an area covered by the front cover. The protecting board prevents access to internal elements of the image forming apparatus which an operator may attempt to access if a paper jam occurs, without also opening the side cover. Thereby, an operator is required to properly open both the front cover and the side cover to address a paper jam situation.

20 Claims, 3 Drawing Sheets

IMAGE FORMING APPARATUS WITH FIRST AND SECOND OPENABLE COVERS

BACKGROUND OF THE INVENTION

1. Field of the Invention

The present invention is directed to an image forming apparatus, such as a copier, a printer, a facsimile, a multiple-function machine, etc., in which interior portions of the image forming apparatus can be accessed by opening first and second covers, and more particularly the present invention is directed to a design of the covers for such an image forming apparatus.

2. Discussion of the Background

A background image forming apparatus, such as a copier, a printer, a facsimile, a multiple-function machine, etc., typically includes a photosensitive body and a fixing unit inside of a front door. In such a background image forming apparatus a paper feed-jam may occur, and when such a paper feed-jam occurs an operator can open the front door of the image forming apparatus and clear the paper feed-jam, for example by rotating a knob coupled to a paper-feeding roller, or by other operations. Such a background image forming apparatus is very common, and it has therefore become very standard practice for an operator of an image forming apparatus to automatically open a front door of the image forming apparatus when a paper feed-jam occurs.

However, recently the miniaturization of such an image forming apparatus has become important. As a result, in certain background image forming apparatuses a process cartridge, which includes a photosensitive body, a fixing unit, and paper feeding rollers may be densely packed, i.e. positioned very close to each other, at one side of the image forming apparatus. In this situation it may occur that the image forming apparatus does not allow easy access to the internal elements thereof which must be accessed when trying to remove a jammed paper sheet by only opening the front door. Such an image forming apparatus may then further include a side door which also has to be opened in conjunction with the front door to properly access the internal elements in the image forming apparatus which must be accessed to remove a jammed paper sheet.

However, most operators of image forming apparatuses are accustomed to only opening a front door of an image forming apparatus to remove a jammed paper sheet. Therefore, the operator may not be aware that a further side door also has to be opened to remove a jammed paper sheet. In this situation, the operator may actually make the paper jam situation worse by only opening the front door of the image forraing apparatus and attempting to remove a jammed paper sheet without opening the side door. In a compact image forming apparatus the operator may actually incur an injury, for example an electric shock, or may damage a photosensitive body when the operator tries to remove a jammed paper sheet in this situation.

One system of addressing preventing an electric shock to an operator is to include an interlock switch in the image forming apparatus which cuts off power when the front door is opened. However, this solution still does not assist the operator in removing the jammed paper sheet, and may still result in the operator damaging the photosensitive body. Such a system with an interlock switch also adds several parts to the image forming apparatus.

SUMMARY OF THE INVENTION

Accordingly, one object of the present invention is to set forth a novel image forming apparatus which addresses and overcomes the above-discussed drawbacks in background image forming apparatuses.

A further object of the present invention is to set forth a novel image forming apparatus which assists an operator in opening the appropriate doors necessary to remove a jammed paper sheet.

A further object of the present invention is to set forth a novel image forming apparatus which prevents an operator from becoming injured or damaging an internal element in an image forming apparatus by attempting to remove a jammed paper sheet before all necessary doors in the image forming apparatus have been opened.

One feature of the present invention to achieve the above-noted and other objects is to provide first and second covers in an image forming apparatus which must be opened to properly access an area where a paper jam may occur, and to set forth an extending portion on one cover to ensure that this one cover is opened prior to an operator being able to access the internal portions of the image forming apparatus where the paper jam may occur.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
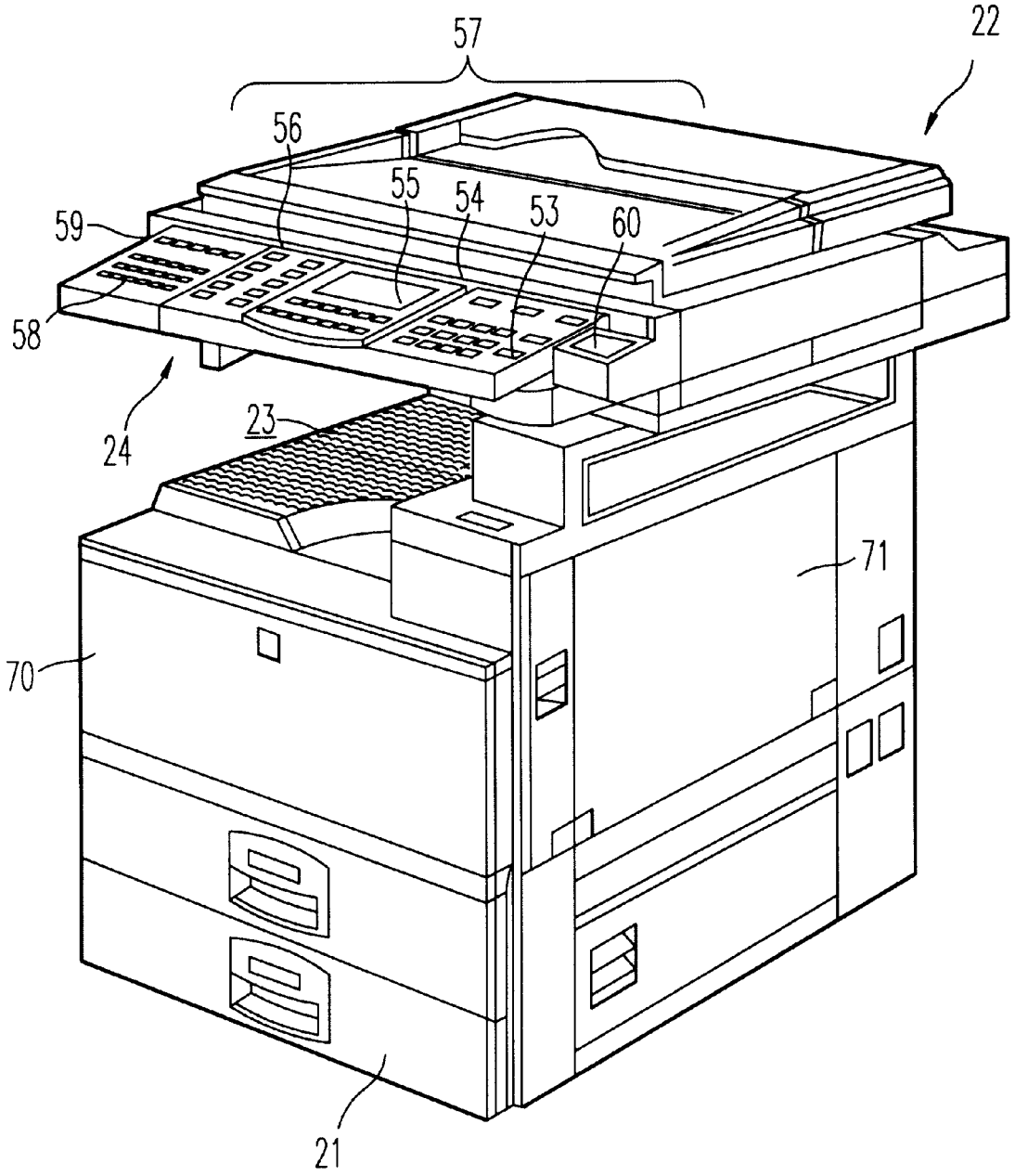
FIG. 1 shows an overall view of a novel image forming apparatus to which the present invention can be applied.

Referring now to the drawings, wherein like reference numerals designate identical or corresponding parts throughout the several views, an overall view of an image forming apparatus in which the present invention can be implemented is shown in FIG. 1.

More particularly, FIG. 1 shows a multi-function machine which can include functions as a copier, facsimile, and printer. The present invention can be applied to other types of image forming apparatuses as will be apparent from the following discussion. The image forming apparatus of FIG. 1 adopts a so-called middle-ejection type system in which an image scanning device 22 for scanning an image is formed above an area for discharging paper sheets, i.e. a paper stacking area 23. Further, the paper stacking area 23 is formed above an image forming portion 20 (see FIG. 2) and a paper storage area 21 for storing paper sheets.

Figure 2:
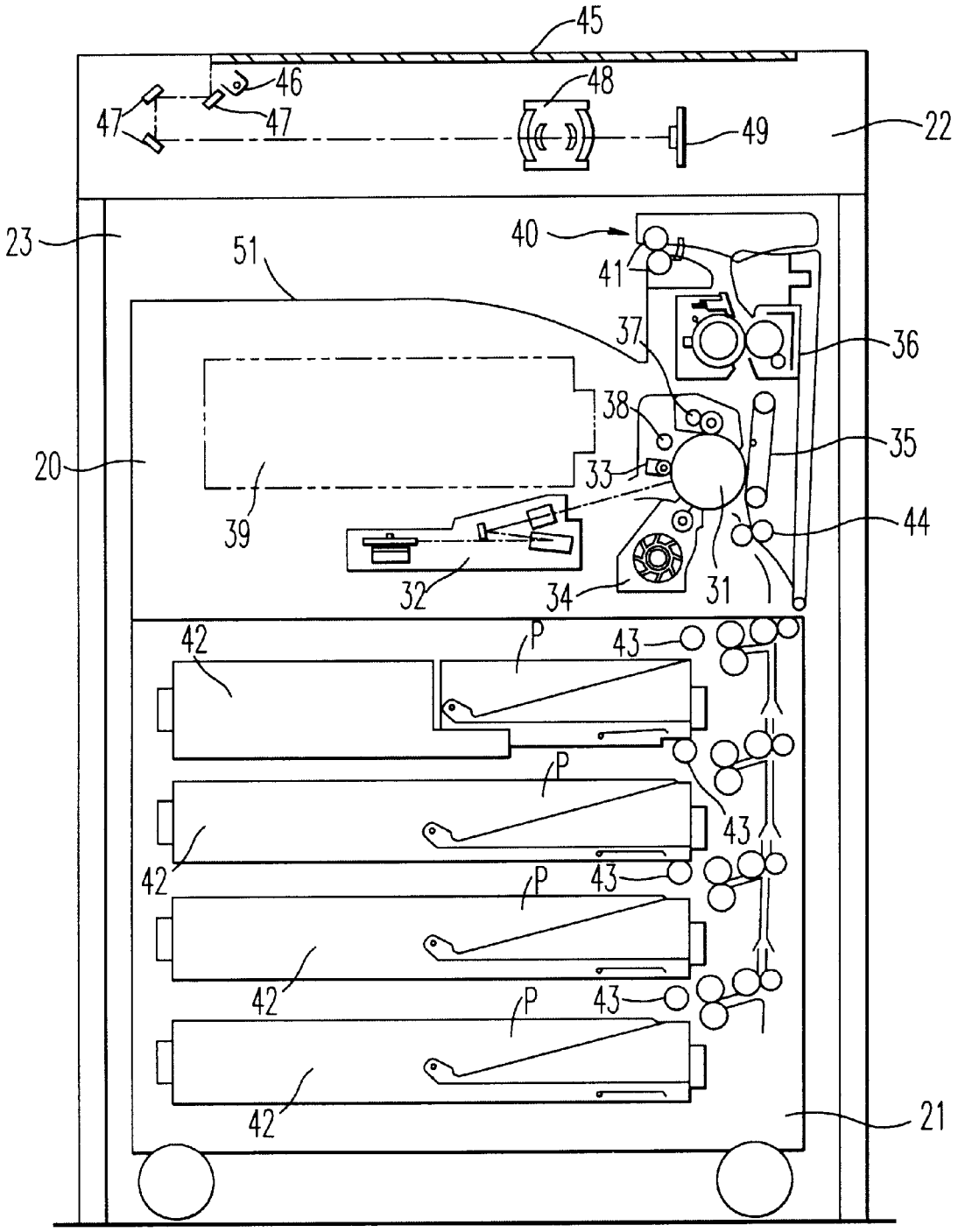
FIG. 2 shows an internal structure of the image forming apparatus of FIG. 1.

FIG. 2 shows a sectional view of the image forming apparatus of FIG. 1.

As shown in FIG. 2, the image forming apparatus includes the image forming portion 20, which in turn includes a photosensitive body 31 and an image writing device 32 for writing a latent image onto the photosensitive body 31. A charger 33 is also provided for uniformly charging the photosensitive body 31. A developing device 34 develops the latent image formed on the photosensitive body 31 into a visible image. A transferring device, e.g. a transferring belt, 35 transfers the visible image to a paper sheet. A fixing unit 40, including a fixing device 36 and discharger rollers 40, then fixes the visible image to the paper sheet. A cleaning unit 37 is provided for cleaning residual toner from the photosensitive body 31 and an electrical discharger 38 is provided for removing any residual electric charge from the photosensitive body 31 after the image forming operation. A toner bottle 39 is further provided for storing toner to be supplied to the developing device 34. A paper sheet having an image printed and fixed thereon is discharged by discharging rollers 41 to a paper stacking area 23 including a paper stacking tray 51.

Further, the paper storage area 21 includes several paper casettes 42, for example four paper cassettes 42 shown in this example. Paper sheets P stored in the paper cassettes 42 are fed by feeding rollers 43 to the image forming part 20 at a timing controlled by rollers 44.

The image forming apparatus further includes the image scanning device 22 which includes a light source 46, mirrors 47, lens system 48, and an image reader 49, for example a charged couple device, for reading an image from a document placed on a contact glass 45. The image read by the image scanning device 22 can be converted into a digital signal, which is then processed and then recorded on the photosensitive body 31 by the image writing device 32.

Referring again to FIG. 1, the external structure of the image forming apparatus includes an upper portion 24 with control panels 57 and 59. The control panel 57 includes a button 53 for starting a copy operation, a ten-key pad 54 for setting various inputs, for example for setting a copy volume, a display 55 showing various conditions, for example a LCD display, and various other input keys 56. This control panel 57 is typically associated with a copy function and may be referred to as a copy-function panel. The control panel 59 typically includes facsimile-functions such as a dial key 58. Switch 60 is a main switch of the image forming apparatus.

The image forming apparatus of FIG. 1 also includes a front cover 70 and a side cover 71. In this image forming apparatus of FIG. 1 if a paper jam event occurs both the front cover 70 and the side cover 71 must be opened to properly access the paper jam area. Further, in this image forming apparatus, and with reference to FIG. 2, the photosensitive body 31 and the transfer belt 35 are in tension contact when the side cover 71 is closed, and opening of the side cover 71 releases the tension contact between the photosensitive body 31 and the transfer belt 35. Thus, to remove a paper jam between the photosensitive body 31 and the transfer belt 35 the side cover 71 must be opened.

Figure 3A:
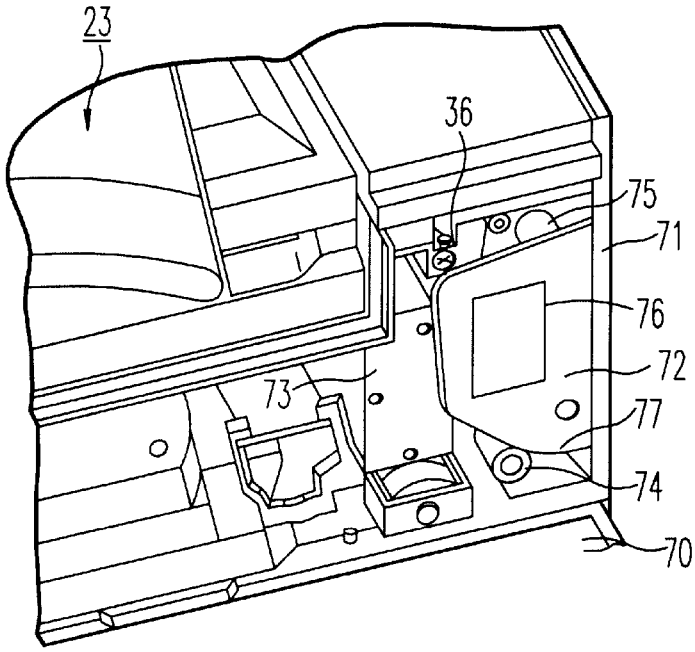
FIGS. 3(A) and 3(B) show a detailed view of a portion of the image forming apparatus of FIG. 1.
Figure 3B:
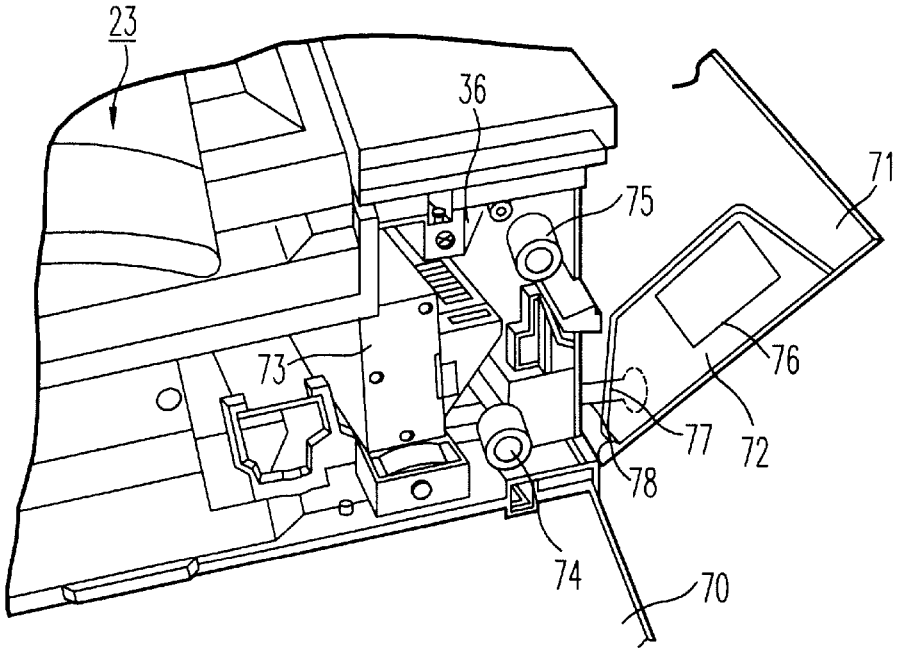

FIG. 3(A) shows the image forming apparatus of FIG. 1 in a state that the front cover 70 is open and the side cover 71 is closed, and FIG. 3(B) shows the image forming apparatus of FIG. 1 in a state that both the front cover 70 and the side cover 71 are open.

As discussed above, a drawback with background compact image forming apparatuses is that since operators have become very familiar with only opening a front door to access a paper jam area and situation, an operator may not properly open the side door when a paper jam occurs, and may attempt to remove a jammed paper sheet with only the front door open. This can result in injury to the operator or damage to the image forming apparatus.

To address this and other situations, the image forming apparatus of the present invention includes an extending portion or protecting board 72 formed as a part of the side cover 71, as shown in FIGS. 3(A) and 3(B). As shown in FIG. 3(A), if an operator opens only the front cover 70 to try to access a paper jam area, the protecting board 72 blocks the area which the operator would need to access to address the paper jam situation. More particularly, the protecting board 72 may be provided to cover a process cartridge unit 73, which may contain the photosensitive body 31 and the charger 32. and to further cover a paper feeding knob 74, a revolving knob 75, and the fixing device 36.

By utilizing the extending portion protecting board 72 at a front edge of the side cover 71 to extend into an area uncovered by front cover 70 when front cover 70 is opened, to properly access the area of the paper jam the operator must open the side cover 71 into the position as shown in FIG. 3(B). When the side cover 71 is opened to the position as shown in FIG. 3(B), the tension between the photosensitive body 31 and the transfer belt 35 is released and a paper jam situation can be easily addressed by the operator. In this situation, the operator can access the paper jam area through the side area exposed by opening the side cover 71.

With such a structure in the present invention, to properly access a paper jam area the operator is required to open both the front cover 70 and the side cover 71. This prevents the operator from attempting to remove a paper jam prematurely, i.e., before the side cover 71 is opened, to thereby protect both the operator and internal elements of the image forming apparatus. Further, in a compact image forming apparatus the area where the paper jam may occur may be concentrated in one portion of the image forming apparatus, for example the right side of the image forming apparatus as shown in FIGS. 3(A) and 3(B), and thereby the protecting board 72 can be made to have a small size.

As also shown in FIGS. 3(A) and 3(B), the protecting board 72 can provide a label 76 with instructions on how to address the paper jam situation. That is, in FIGS. 3(A) and 3(B) element 76 shows an area at which a label can be provided on the protecting board 72 to instruct the operator how to address the paper jam situation. The protecting board 72 provides a convenient position for such an instruction label 76. Further, the protecting board 72 can have an angled side 77 which prevents requiring the side cover 71 to be completely opened to access the internal portions of the image forming apparatus. As shown more clearly in FIG. 3(B), to access a paper jam area the side cover 71 only has to be opened to a portion such that the angled side 77 clears the internal elements of the image forming apparatus. Further, as shown in FIG. 3(B) the side cover 71 can include a stop device 78, for example a flexible strap, which stops the open position of the side cover 71 at the position where the angled side 77 of the protecting board 72 just clears the internal elements of the image forming apparatus. This prevents requiring full opening of the side cover 71, to conserve space requirements.

The present invention has been described above with respect to a middle-ejection type image forming apparatus, but clearly the present invention can be applicable to several types of image forming apparatuses, including a side-ejection type and a top-ejection type. The present invention can also be applied to other image forming apparatuses than the multi-function apparatus described above.

Obviously, numerous additional modifications and variations of the present invention are possible in light of the above teachings. It is therefore to be understood that within the scope of the appended claims, the present invention may be practiced otherwise than as specifically described herein.

The present document is based on Japanese Priority Document 09-344089 filed in the Japanese Patent Office on Nov. 28, 1997, the entire contents of which are incorporated herein by reference.

We claim:

1. An image forming apparatus, comprising:

an image forming part in which a paper path is included;

a first cover configured to open and close and to cover a first portion of the image forming part, including at least a portion of the paper path, in a closed state and to uncover the first portion of the image forming part in an open state;

a second cover configured to open and close and to cover a second portion of the image forming part in a closed state, said second cover including an extending portion extending to cover, in the closed state of the second cover, at least a part of the first portion of the image forming part uncovered by the first cover in the open state of the first cover.

2. An image forming apparatus according to claim 1, wherein the first cover is a front cover and the second cover is a side cover.

3. An image forming apparatus according to claim 1, wherein the image forming part includes a fixing unit.

4. An image forming apparatus according to claim 1, wherein the image forming part includes a photoconductive body and a transfer belt in tension contact in a closed state of the second cover, and wherein opening of the second cover releases tension between the photoconductive body and the transfer belt.

5. An image forming apparatus according to claim 1, wherein the extending portion has an angled side.

6. An image forming apparatus according to claim 1, wherein the extending portion includes a warning label.

7. An image forming apparatus according to claim 3, wherein the fixing unit includes a manual feed knob.

8. An image forming apparatus according to claim 3, wherein the image forming part further includes a photoconductive body and a transfer belt in tension contact in a closed state of the second cover, and wherein opening of the second cover releases tension between the photoconductive body and the transfer belt.

9. An image forming apparatus according to claim 8, wherein the fixing unit further includes a manual feed knob.

10. An image forming apparatus according to claim 1, further comprising a cover stop connected to the second cover to stop the second cover in an open state so that the extending portion uncovers the image forming part to allow access to the image forming part.

11. An image forming apparatus, comprising:

an image forming means for forming an image on a sheet in which a paper path is included;

a first cover means for covering a first portion of the image forming means, including at least a portion of the paper path, in a closed state and for uncovering the first portion of the image forming means in an open state;

second cover means for covering a second portion of the image forming means in a closed state, said second cover means including an extending means extending for covering, in the closed state of the second cover means, at least a part of the first portion of the image forming means uncovered by the first cover means in the open state of the first cover means.

12. An image forming apparatus according to claim 11, wherein the first cover means is a front cover and the second cover means is a side cover.

13. An image forming apparatus according to claim 11, wherein the image forming means includes a fixing means for fixing an image on the sheet.

14. An image forming apparatus according to claim 11, wherein the image forming means includes a photoconductive means and a transfer means in tension contact in a closed state of the second cover means, and wherein opening of the second cover means releases tension between the photoconductive means and the transfer means.

15. An image forming apparatus according to claim 11, wherein the extending means has an angled side.

16. An image forming apparatus according to claim 11, wherein the extending means includes a warning means.

17. An image forming apparatus according to claim 13, wherein the fixing means includes a manual feed means.

18. An image forming apparatus according to claim 13, wherein the image forming means further includes a photoconductive means and a transfer means in tension contact in a closed state of the second cover means, and wherein opening of the second cover means releases tension between the photoconductive means and the transfer means.

19. An image forming apparatus according to claim 18, wherein the fixing means further includes a manual feed means.

20. An image forming apparatus according to claim 11, further comprising a cover stop means connected to the second cover means for stopping the second cover means in an open state so that the extending means uncovers the image forming means to allow access to the image forming means.

* * * * *

UNITED STATES PATENT AND TRADEMARK OFFICE

CERTIFICATE OF CORRECTION

PATENT NO. : 6,075,958
DATED : June 13, 2000
INVENTOR(S) : Tetsuya Goto, et al.

It is certified that error appears in the above-identified patent and that said Letters Patent is hereby corrected as shown below:

Title Page,
Item [75] the 1st Inventor's name is listed incorrectly. Item [75] should read as follows:

[75] Inventors: Tetsuya Goto: Yuji Suzuki, both of Yokohama; Masahiro Nakajima, Tokyo; Shigeru Horiguchi, Kawasaki, all of Japan Title Page,
Item [30] the Foreign Application Priority Data is missing. Item [30] should read as follows:

[30] Foreign Application Priority Data

Nov. 28, 1997 [JP] Japan..... 9-344089

Signed and Sealed this

Thirty-first Day of July, 2001

*Attest:*

Nicholas P. Godici

*Attesting Officer*

NICHOLAS P. GODICI
*Acting Director of the United States Patent and Trademark Office*